US007325437B2

(12) United States Patent
Boatright et al.

(10) Patent No.: US 7,325,437 B2
(45) Date of Patent: Feb. 5, 2008

(54) LONG REACH PRESS

(76) Inventors: Jeff Boatright, c/o 26 Adams Boulevard, Brantford, Ontario (CA) N3S 7V2; Quinn Smith, c/o 26 Adams Boulevard, Brantford, Ontario (CA) N3S 7V2; Byron Selorme, c/o 26 Adams Boulevard, Brantford, Ontario (CA) N3S 7V2

( * ) Notice: Subject to any disclaimer, the term of this patent is extended or adjusted under 35 U.S.C. 154(b) by 192 days.

(21) Appl. No.: 11/094,125

(22) Filed: Mar. 31, 2005

(65) Prior Publication Data

US 2005/0223773 A1 Oct. 13, 2005

Related U.S. Application Data

(60) Provisional application No. 60/586,223, filed on Jul. 9, 2004, provisional application No. 60/561,527, filed on Apr. 13, 2004.

(51) Int. Cl.
*B21D 7/06* (2006.01)
*B21J 7/46* (2006.01)

(52) U.S. Cl. ..... 72/407; 72/444; 72/448; 72/404; 100/244; 100/264; 100/350; 29/509

(58) Field of Classification Search ..... 72/404, 72/407, 444, 448; 100/244, 264, 350; 29/509
See application file for complete search history.

(56) References Cited

U.S. PATENT DOCUMENTS

| | | | | | |
|---|---|---|---|---|---|
| 509,683 | A * | 11/1893 | Redmond | 72/448 |
| 530,162 | A * | 12/1894 | Cuenot | 72/448 |
| 1,246,170 | A * | 11/1917 | Shuster | 72/444 |
| 2,312,554 | A * | 3/1943 | Jacques | 72/407 |
| 2,442,949 | A * | 6/1948 | Fischer | 72/407 |
| 4,484,119 | A | 11/1984 | Kerr | 318/563 |
| 5,060,362 | A * | 10/1991 | Birke et al. | 29/243.53 |
| 5,931,070 | A | 8/1999 | Miyajima | 83/39 |
| 6,128,987 | A | 10/2000 | Nakagawa | 83/76.9 |
| 6,389,940 | B1 * | 5/2002 | Long et al. | 100/264 |
| 6,418,824 | B1 | 7/2002 | Duggins | 83/62.1 |

* cited by examiner

*Primary Examiner*—David B Jones

(57) ABSTRACT

The present invention is a long reach press comprising a low force actuator for operably urging first tooling into a working position. It further includes an opposed high force actuator for operably urging second tooling into engagement with the first tooling. The low force actuator includes a positive stop actuator including a slide block stop for operatively supporting and restraining movement of the first tooling when engaged with the second tooling. The slide block is moveable between a stop extended position and a stop retracted position.

11 Claims, 11 Drawing Sheets

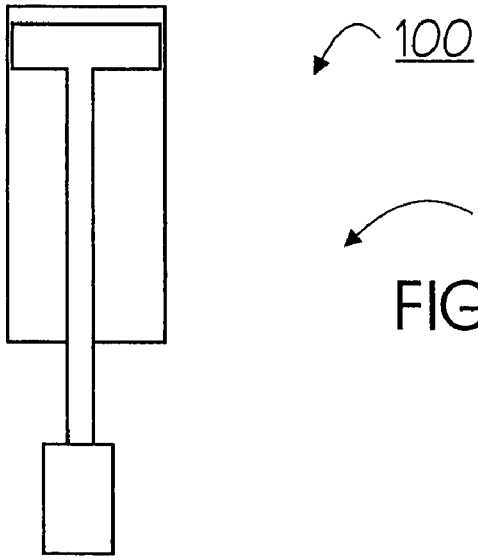
FIGURE-3
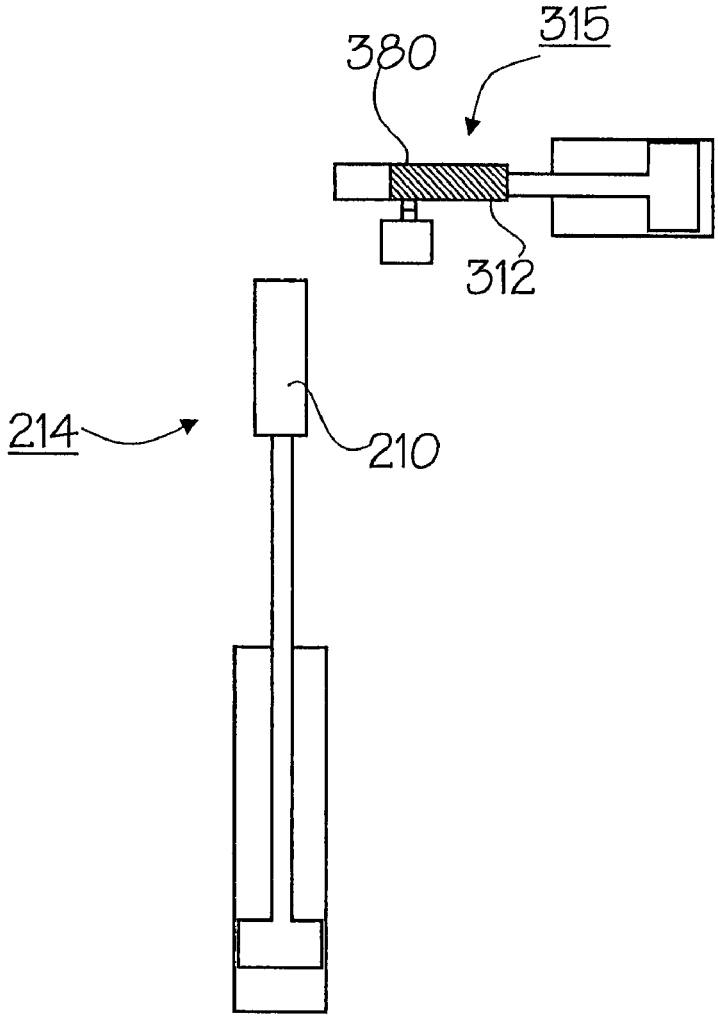

LONG REACH PRESS

The present application claims priority from previously filed Provisional Application 60/586,223 filed Jul. 9, 2004 as well as U.S. Provisional 60/561,527 filed Apr. 13, 2004.

FIELD OF THE INVENTION

The present invention relates to presses and in particular relates to pneumatic hydraulic and air operated long reach presses.

BACKGROUND OF THE INVENTION

Presses are used for stamping, punching, clinching, nut insertion, shearing and other functions on metals and other materials. Presses generally are designed to impart forces onto working materials and these forces are generated through mechanical, hydraulic, pneumatic or air actuated devices. Specialized presses have been developed for working with parts that have particularly deep sections, such as channel letters. Channel letter for example have a back plate which is clinched to a side wall producing a deep and wide U-channel which is then used for production of letters of various shapes. These channel letters can exceed 10 inches in depth and in order to fasten the back plate to the side wall, the press must have sufficient reach in order to penetrate this depth so that the pressing operation which in this particular case is clinching can be carried out.

Typically in order to carry out the clinching process, the two parts to be clinched together must be sandwiched between male and female tooling components, wherein these tooling components are brought into contact with the parts to be assembled via the press. Therefore, when one wishes to clinch together two parts having a large depth profile, such as channel letters, the difficulty that one faces is presenting the parts in between the male and female tooling components. Currently the practice is to have a long upright standing fixed lower tooling which is long enough to penetrate the entire depth of the channel letter. The upper tooling is attached to an upper hydraulic cylinder having a very long stroke capability such that when the upper hydraulic cylinder is in the retracted position, the operator can manoeuvre the channel letter onto the lower fixed tooling. This set up requires the use of expensive long stroke hydraulic cylinders with the associated safety issues that arise when the upper tooling approaches the part in order to carry out clinching and/or other pressing operations.

It would be desirable to be able to provide for a long reach press which eliminates the safety issues and the expense of the requirement of having a long reach hydraulic type cylinder in order to achieve the long strokes required for parts having large depth profiles.

SUMMARY OF THE INVENTION

Long reach press comprising:

(a) a high force actuator connected at one end to upper tooling 110 having the capability of moving upper tooling under high forces:

(b) lower tooling adapted to cooperate and make contact with upper tooling and a low force means for moving lower tooling between a lower tooling lowered position and a lower tooling raised position, such that when lower tooling is in the raised position the upper and lower tooling will make contact upon actuation of the high force actuator.

Wherein the low force means includes a low force actuator, capable of moving lower tooling between a lower tooling lowered position and a lower tooling raised position.

Wherein said low force means further including a positive stop actuator which includes a slide block stop, wherein said slide block stop can be extended between a stop extended position and a stop retracted position, wherein the stop extended position and the tooling in the lower tooling raised position, the lower tooling is prevented from moving downwardly against the slide block stop.

The present invention a long reach press includes:

1) a low force actuator for operably urging first tooling into a working position;

(b) an opposed high force actuator for operably urging second tooling into engagement with the first tooling;

(c) wherein said low force actuator including a positive stop means for restraining movement of the first tooling when in engagement with the second tooling.

Preferably wherein said stop means including a positive stop actuator including a slide block stop for operatively supporting and restraining movement of the first tooling when engaged with the second tooling.

Preferably wherein said slide block moveable between a stop extended position and a stop retracted position.

Preferably wherein said first tooling being lower tooling positioned below and vertically opposed to second tooling being upper tooling positioned vertically above lower tooling.

The present invention a long reach press includes:

(a) a low force actuator for operably urging lower tooling into a raised position;

(b) a vertically opposed high force actuator for operably urging upper tooling into engagement with the lower tooling;

(c) the press further including a positive stop means for restraining movement of the lower tooling when in a raised position and in engagement with the upper tooling.

Preferably, wherein the stop means including a positive stop actuator including a slide block stop for operatively supporting and restraining movement of the lower tooling when engaged with the upper tooling.

Preferably, wherein the slide block moveable between a stop extended position and a stop retracted position.

Preferably, wherein the positive stop actuator including a position sensor for monitoring the position of the slide block stop as it moves between the stop extended position and the stop retracted position.

Preferably, wherein the slide block stop slideably received with a lower tooling housing.

Preferably, wherein the low force actuator moveable between a lowered position and a raised position when the slide block stop in the stop retracted position thereby defining a lower stroke.

Preferably, wherein the lower tooling moving along a vertical direction and the slide block stop moving along a lateral direction perpendicular to the vertical direction.

Preferably, wherein the high force actuator including a WAMP unit capable of moving the upper tooling along an upper stroke and into engagement at high force with the lower tooling.

Preferably, wherein the lower tooling when in the lowered position is retracted below a working table such that the work piece can be easily slid over top of the lower tooling.

Preferably, wherein said slide block stop being U shaped for operably engaging with a lower tooling stop surface.

The present invention a method of operating a press includes:

(a) placing a work piece on a working table; wherein mounted below the working table a low force actuator including lower tooling; and mounted above the working table a vertically opposed high force actuator including upper tooling;

(b) urging under low force, lower tooling from below the table into a raised position thereby engaging and supporting said work piece;

(c) a means for restraining movement of the lower tooling when in a raised position.

(d) urging under high force upper tooling into engagement with the work piece and lower tooling;

Preferably wherein said restraining means including a positive stop means for restraining movement of the lower tooling when in the raised position and in engagement with the upper tooling.

Preferably wherein the stop means including a positive stop actuator including a slide block stop for operatively supporting and restraining movement of the lower tooling when engaged with the upper tooling.

The present invention a long reach press includes:

(a) a high force actuator including at one end upper tooling, wherein the actuator operable for moving upper tooling under high forces;

(b) a low force actuator for operable urging lower tooling between a lowered position and a raised position, such that when lower tooling is in the raised position the upper and lower tooling will make contact upon actuation of the high force actuator.

Preferably, wherein said low force means further including a positive stop actuator which includes a slide block stop, wherein said slide block stop can be extended between a stop extended position and a stop retracted position, wherein the slide block stop in the stop extended position and the lower tooling in the raised position, the lower tooling is prevented from moving downwardly past the slide block stop.

BRIEF DESCRIPTION OF THE DRAWINGS

The invention will now be described by way of example only with reference to the following drawings in which:

FIG. 3 is a schematic representation of the present invention a long reach press with the stop in the retracted position.

DETAILED DESCRIPTION OF THE PREFERRED EMBODIMENT

Definitions

"High Force"=Normally greater than 100 lb force

For clinching operations normally greater than 1000 lb force is used and typically closer to 5000 lbs force is employed.

"Low Force"—Normally less than 100 lb force, and typically 30 lbs force is employed in order to avoid operator injury.

Prior Art

Figure 1:
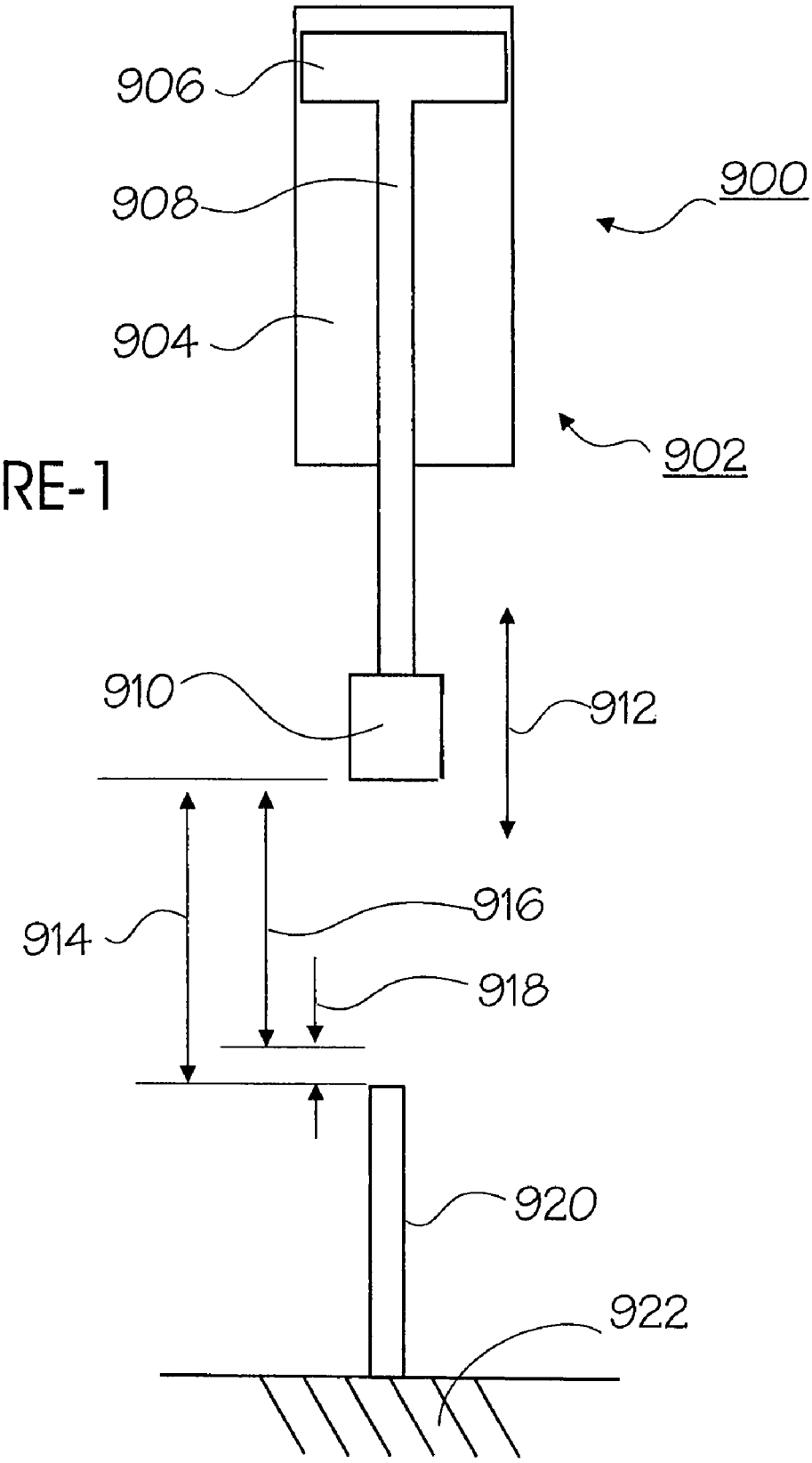
FIG. 1 is a schematic representation of a conventional currently used prior art press.

Referring first of all to FIG. 1 which shows a prior art press shown generally as 900. Prior art press 900 includes a high and low force actuator 902 comprised of a single hydraulic cylinder 904, piston 906, piston rod 908 having attached on one end thereof upper tooling 910. In order to achieve the long reach required, high and low force actuator 902 moves through a long upper stroke 914 which is comprised of both a low force stroke portion 916 and a high force stroke portion 918 as depicted in FIG. 1. In other words, hydraulic cylinder 904 advances upper tooling 910 through a very long upper stroke 914 in two stages. Firstly it advances upper tooling 910 under low pressure or low force, along low force stroke 916 and then as upper tooling 910 approaches the work piece it applies high force, moving upper tooling 910 through high force stroke 918. In order to achieve this type of controlled movement of hydraulic cylinder 904, sophisticated and expensive controls must be applied to hydraulic cylinder 904 in order to carefully control the low and high force strokes. Upper stroke 914 may be of the order of six to 12 inches.

Further, lower tooling 920 is fixed to a base 922 and work pieces must be placed over the top of lower tooling 920 for further operation. The disadvantages of prior art press 900 as shown in FIG. 1 are the expensive dual stroke hydraulic cylinder 904 that is required along with the sophisticated control system necessary in order to move upper tooling 910 through the low force stroke portion 916 and as well as the high force stroke portion 918. Secondly, there is the issue of safety, particularly of concern is injury to personnel using prior art press 900. The large movement of upper tooling 910 through upper stroke 914 increases the likelihood that something or somebody could be caught and/or injured by the movement of upper tooling 910 unless the force of the upper tooling movement is in some manner controlled to eliminate the possibility of injury. Thirdly, it is very inconvenient and time consuming and labour intensive to move the work piece onto the fixed lower tooling 920 and generally speaking manual labour must be employed in order to lift parts, such as channel members manually over top of lower tooling 920 so that it can be presented to upper tooling 910.

Present Invention

The present invention is a described and depicted in the remainder of the drawings in particularly referring to FIGS. 2 through 6, the present invention a long reach press is shown generally as 100 and includes the following major components, namely high force actuator 102, low force actuator 202 and positive stop actuator 302.

Figure 2:
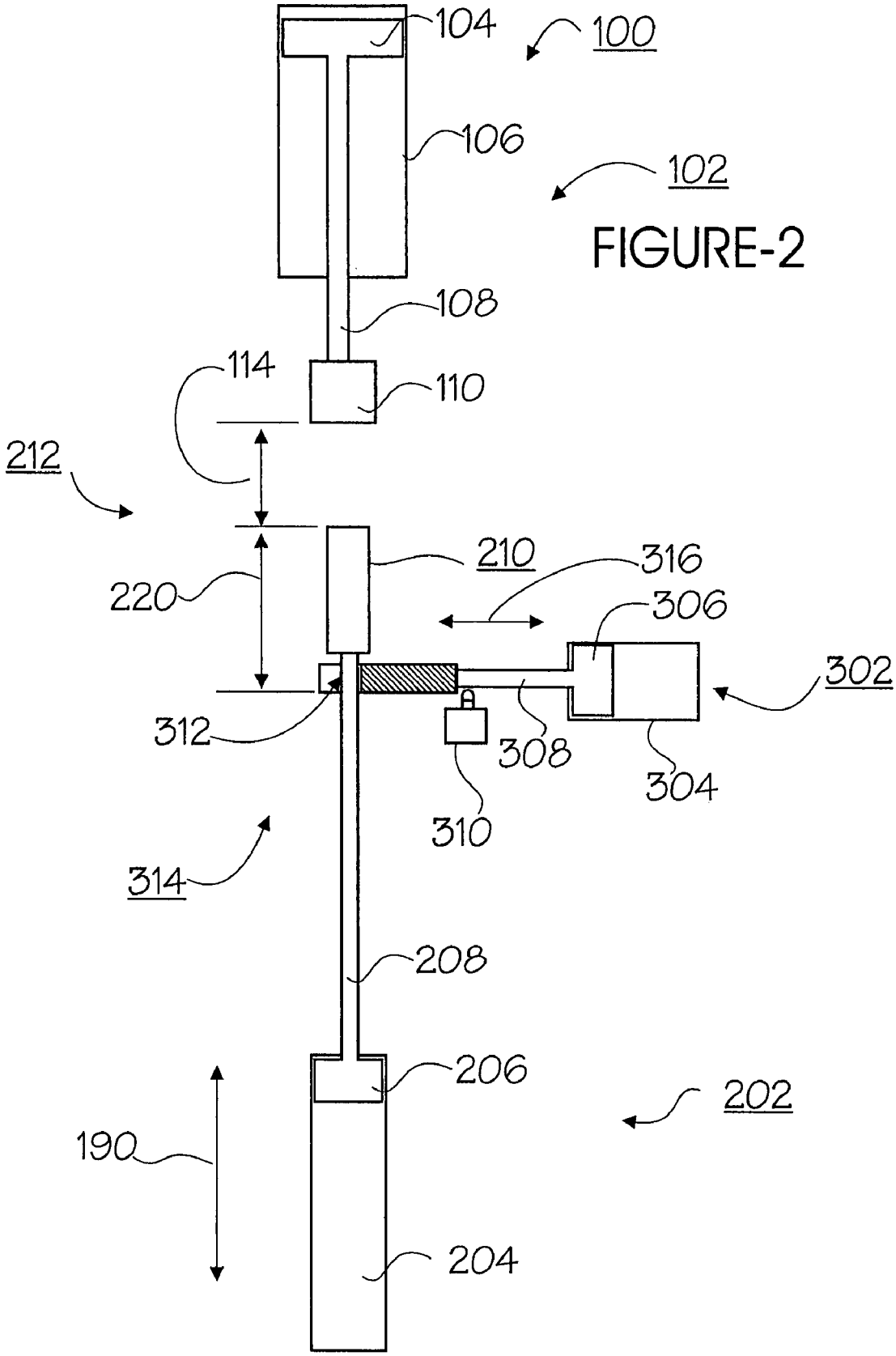
FIG. 2 is a schematic representation of the present invention, a long reach press with the stop in the extended position.

High force actuator 102 includes piston 104, cylinder 106, piston rod 108, having upper tooling 110 attached at one end thereof. Upper tooling 110 moves through a high force small upper stroke 114 as depicted in FIG. 2. Upper stroke 114 is usually of the order of ½" to 1". A person skilled in the art will note that high force actuator 102 maybe selected from various commercial units that are currently on the market. It may include a hydraulic cylinder, a pneumatic cylinder, an air diaphragm pneumatic actuator or any other types of high force actuator which will provide the necessary force and stroke for the application.

Low force actuator 202 includes cylinder 204, piston 206, cylinder rod 208 and lower tooling 210 which is shown in lower tooling raised position 212 in FIG. 2. Lower tooling 210 is moved through lower stroke 220 under low force conditions. Lower stroke 212 is usually of the order of 3" to 15", or even more.

Positive stop actuator 302 includes cylinder 304, piston 306, cylinder rod 308, a position sensor 310 and a slide block stop 312. Slide block stop 312 is shown in the stop extended position 314 and is moved laterally along lateral direction 316 as shown in FIG. 2.

Lower tooling 210 is shown in the lower tooling lowered position 214 in FIG. 3 and slide block stop 312 is shown in the stop retracted position 315 also in FIG. 3. Slide block stop 312 moves along lateral direction 316 between stop retracted position 315 and stop extended position 314.

Figure 4:
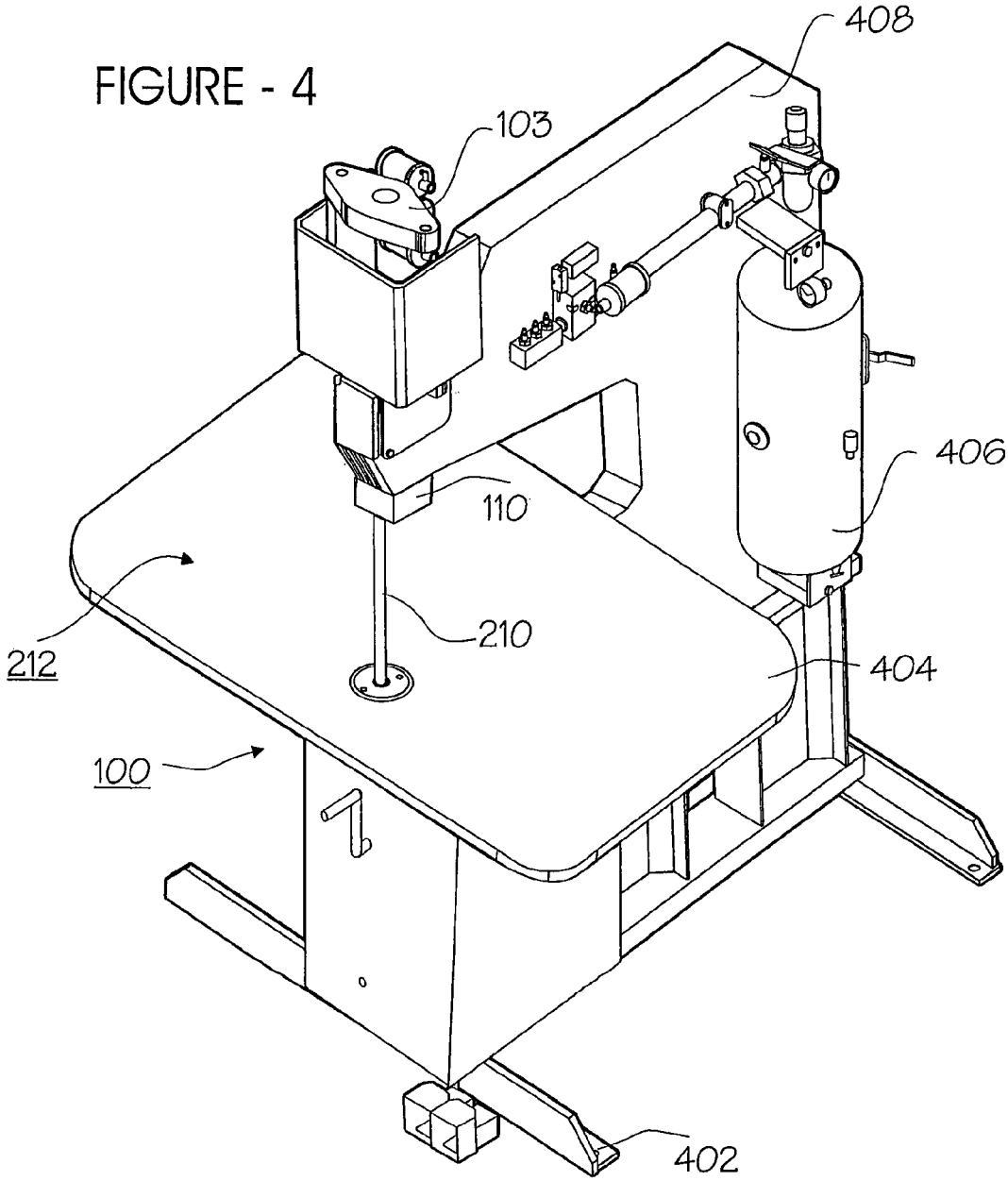
FIG. 4 is a front schematic perspective view of the present invention, a long reach press mounted onto a frame.

Referring now to FIG. 4, showing the present invention the long reach press 100 installed in typical fashion in a C-frame 408 which includes an air reservoir 406, a working table 404, base 402. The high force actuator preferably is a WAMP actuator 103 (WAMP=whiting air multiple press) which is a diaphragm type air multiple pneumatic press capable of moving upper tooling 110 through upper stroke 114 at the forces required.

Figure 5:
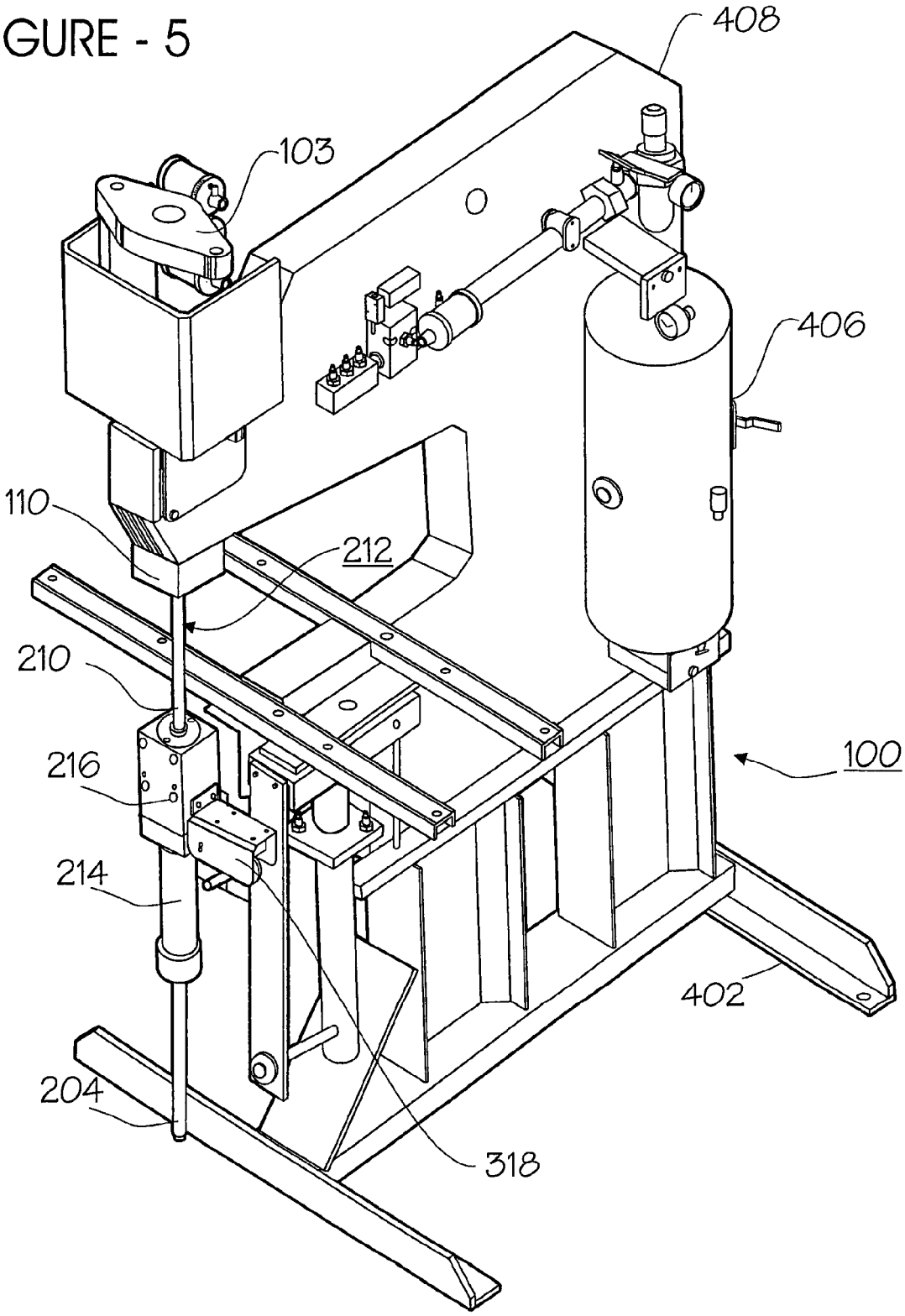
FIG. 5 is a front schematic perspective view of the present invention, a long reach press mounted onto a frame with the table and guards removed showing the high force actuator and the low force actuator.

Referring now to FIG. 5, which shows the long reach press 100 mounted onto a C-frame 408, wherein for greater clarity, working table 404 as well as some guarding has been removed. Lower tooling 210 is shown in lower tooling raised position 212 and low force actuator 202 further includes lower tooling housing 216 and cylinder mounting spacer 214. Positive stop actuator 302 further includes positive stop housing 318 as depicted in FIG. 5.

Figure 6:
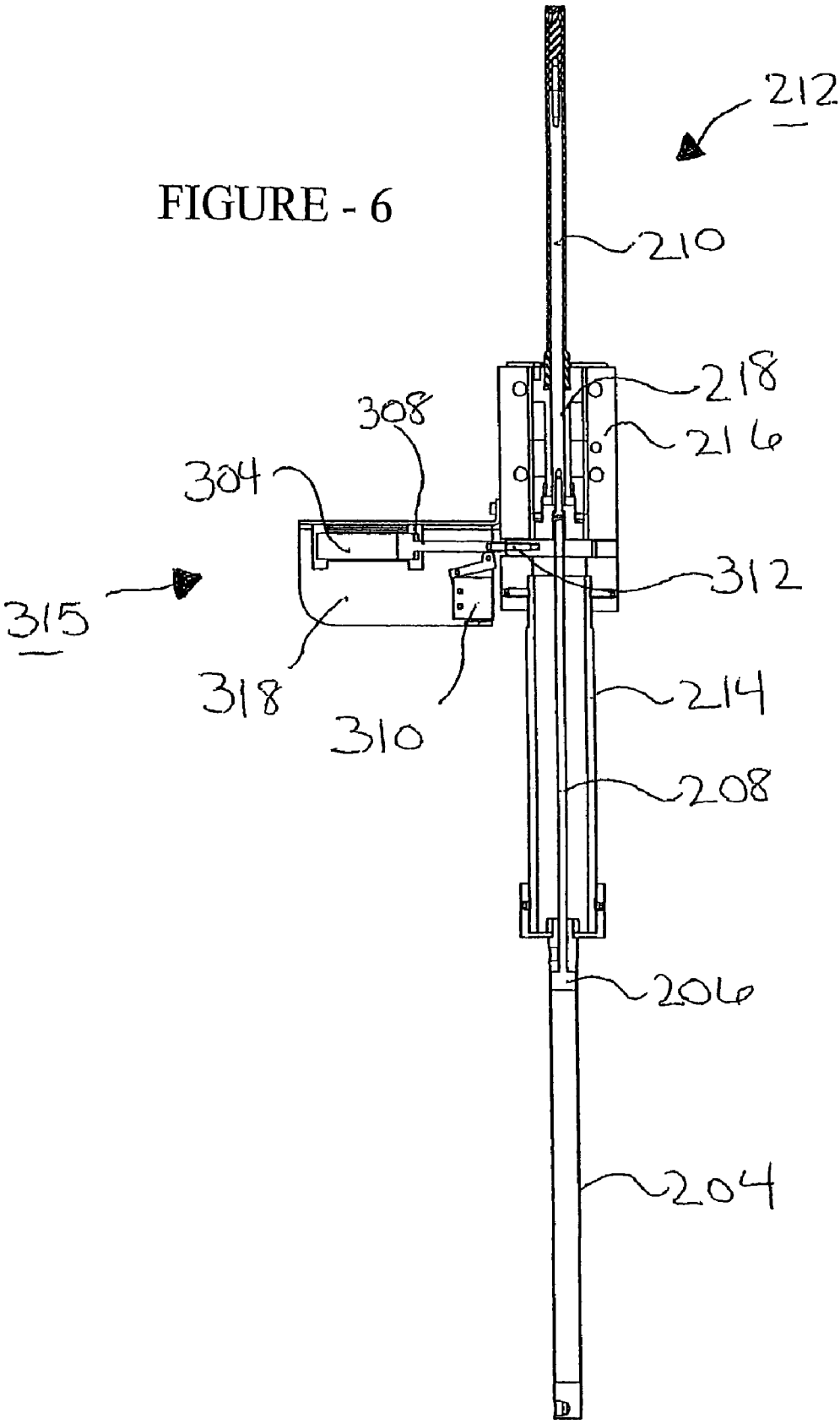
FIG. 6 is a schematic cross sectional view of the low force actuator together with the positive stop actuator.

Referring now to FIG. 6, low force actuator 202 is depicted together with positive stop actuator 302 in cross sectional fashion with lower tooling 210 in the lowered tooling raised position 212 and the slide block stop 312 in stop retracted position 315. With slide block stop 312 in retracted position 315, lowering tooling 210 can be raised and lower by piston 206 sliding within cylinder 204. FIG. 6 further more clearly depicts cylinder mounting spacer 214 as well as guide sleeve 218 and lower tooling housing 216.

Figure 7:
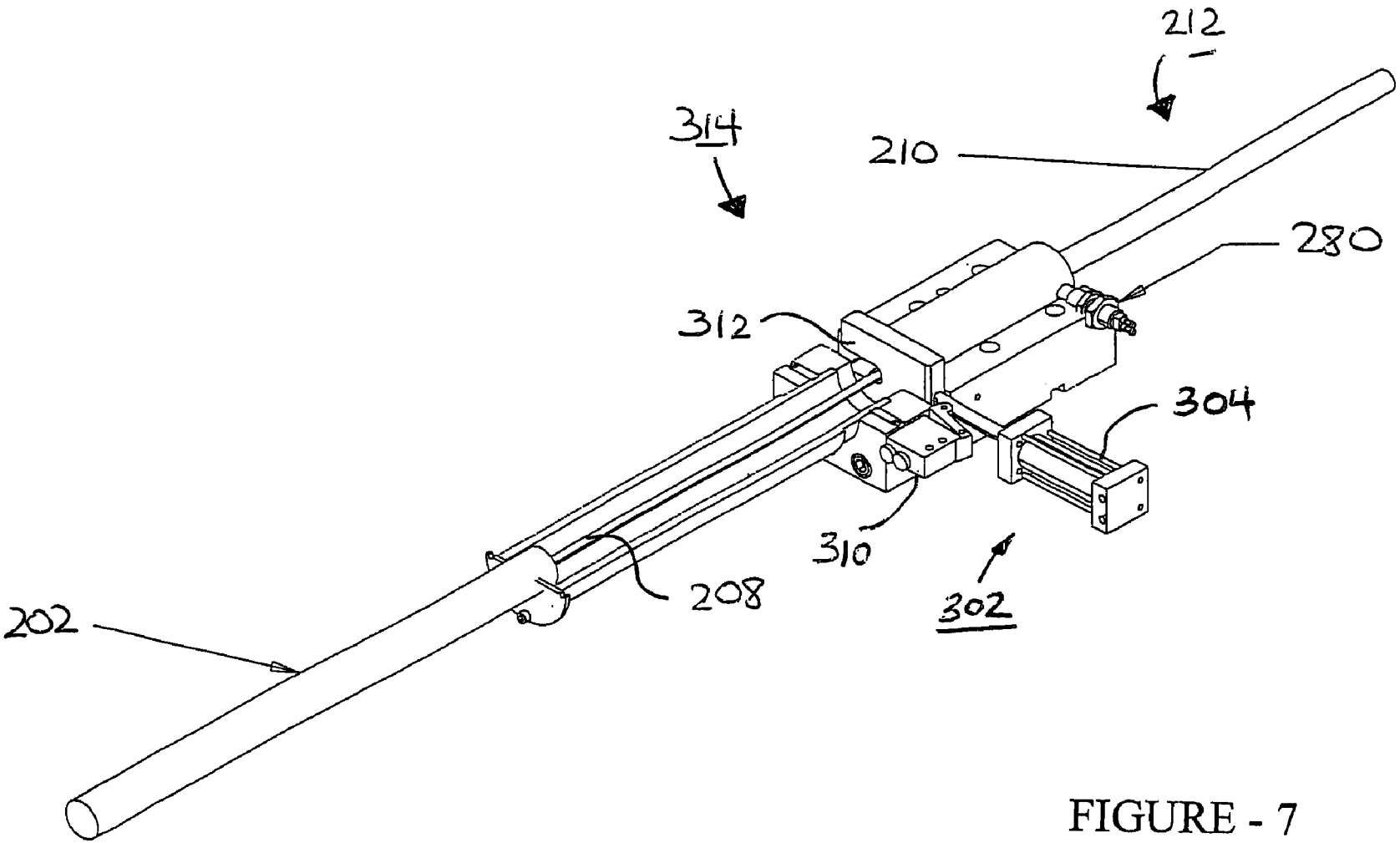
FIG. 7 is a schematic top perspective view of the low force actuator together with the positive stop actuator with the lower tooling in the raised position, and the stop in the extended position.
Figure 8:
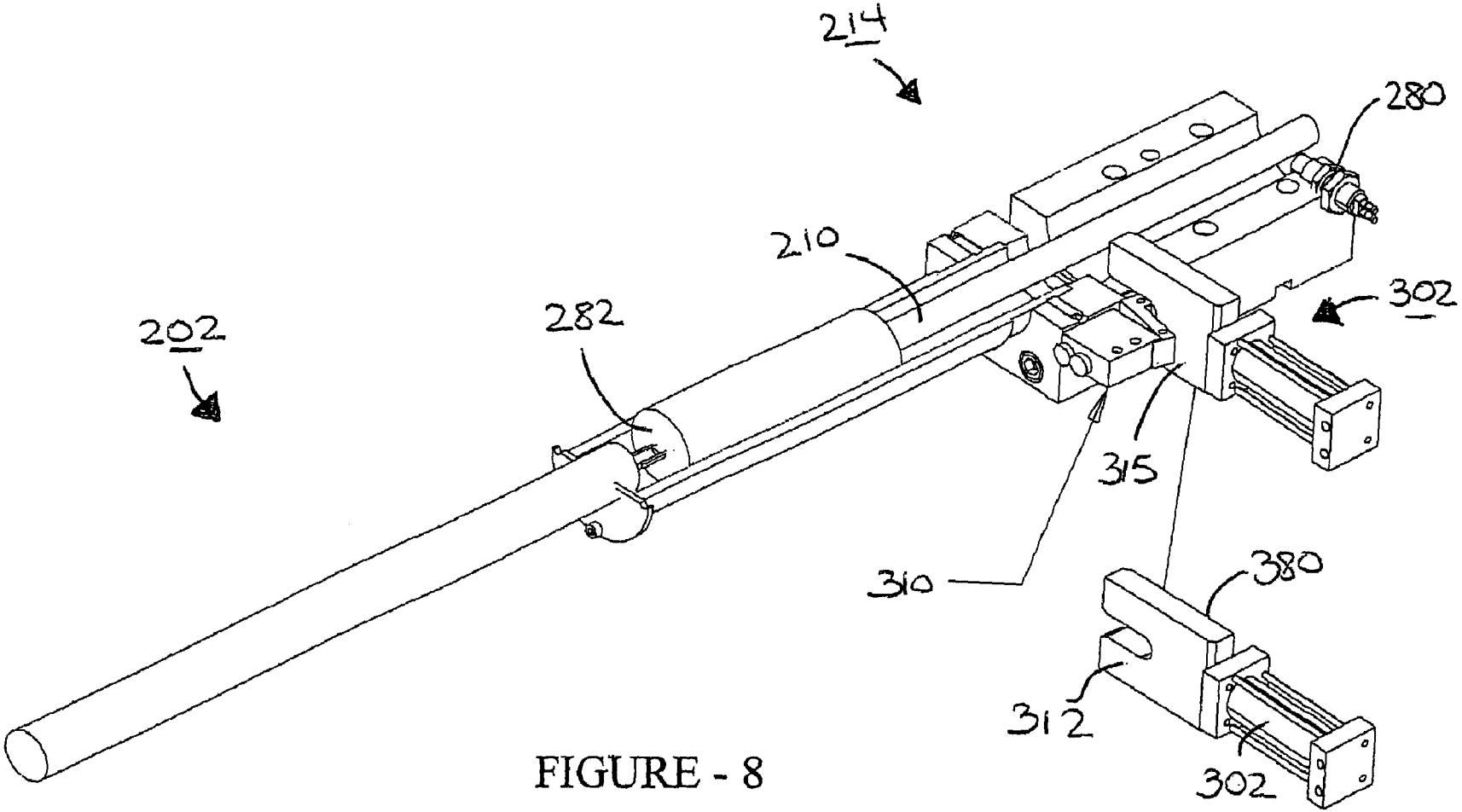
FIG. 8 is a schematic top perspective view of the low force actuator together with the positive stop actuator with the lower tooling in the lower position. The stop on the retracted position showing details of the slide block stop.

Referring now to FIG. 7 and 8 for further clarification, FIG. 7 is a top schematic perspective view of the low force actuator 202 together with the positive stop actuator 302 with lower tooling 210 in the lower tooling raised position 212 and slide block stop 312 in the stop extended position 314. The drawings also show cylinder rod 208 together with stop position sensor 310 and lower tooling position sensor 280.

FIG. 8 is a top schematic perspective view of the low force actuator 202 together with the positive stop actuator 302 showing the lower tooling 210 in the lower tooling lowered position 214 together with slide block stop 312 in the stop retracted position 315 and as well showing a lower tooling stop surface 282 which makes contact with stop face 380 of slide block stop 312 when the lower tooling 210 is in the raised position 212.

Figure 9:
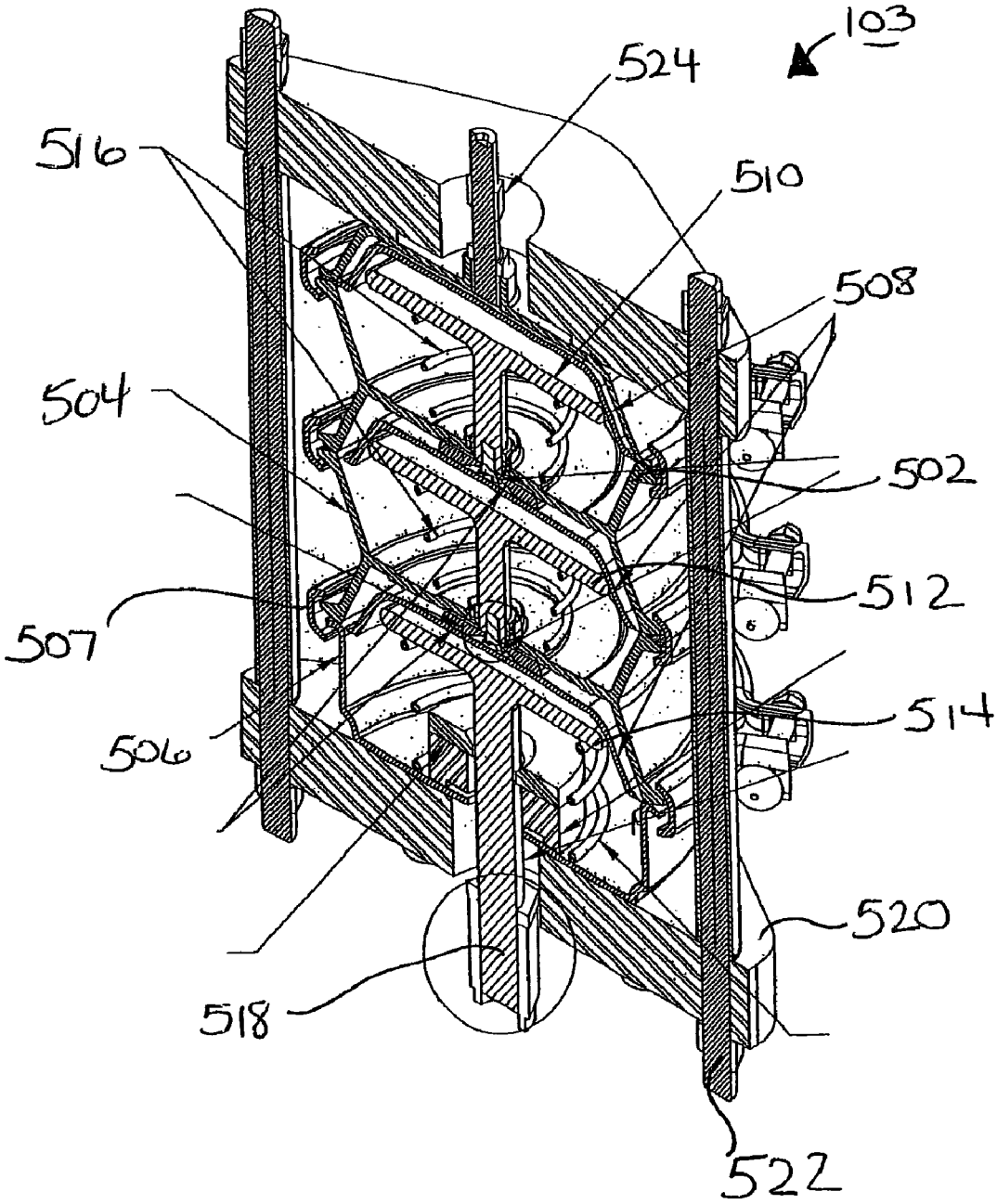
FIG. 9 is a schematic cross sectional view of a WAMP actuator showing the internal details.

Referring now to FIG. 9 which is a schematic cross sectional view of WAMP actuator 103 wherein WAMP stands for WHITING AIR MULTIPLE PRESS, one will see that WAMP actuator 103 includes 3 chambers namely upper chamber 502, intermediate chamber 504 and lower chamber 506 and within each chamber is housed a diagram 508 together with a plunger, namely upper plunger 510 in upper chamber 502, intermediate plunger 512 in intermediate chamber 504 and lower plunger 514 in lower chamber 506. Each chamber is defined by housing 507 and the housings are held together by frame 520 and rods 522. Lower plunger 514 includes an output shaft 518 for transferring the force as desired. Return springs 516 returns the plungers 510, 512 and 514 and the diaphragms 508 after the power stroke has been completed. In addition, there is an adjusting nut 524 to adjust the upper range of the stroke. WAMP units typically use approximately 100 PSI of air which is inlet into each chamber individually, thereby multiplying the force that is available at output shaft 518. Typically 3000 pounds of force are available per chamber for a total of 9000 pounds of force at the output shaft and typically the power stroke is approximately 1" in length. WAMP actuator 103 is the unit which can be used in the high force actuator 102 portion of long reach press 100, however other actuators are also possible. The advantage of the WAMP actuator 103 is the lower cost, the very high force, the low stroke and the large number of power strokes that can be obtained in the short period of time.

Figure 10:
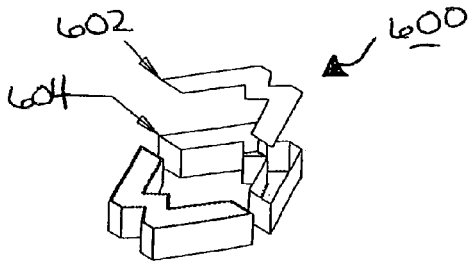
FIG. 10 is a schematic top perspective view of the components of a channel letter.
Figure 11:
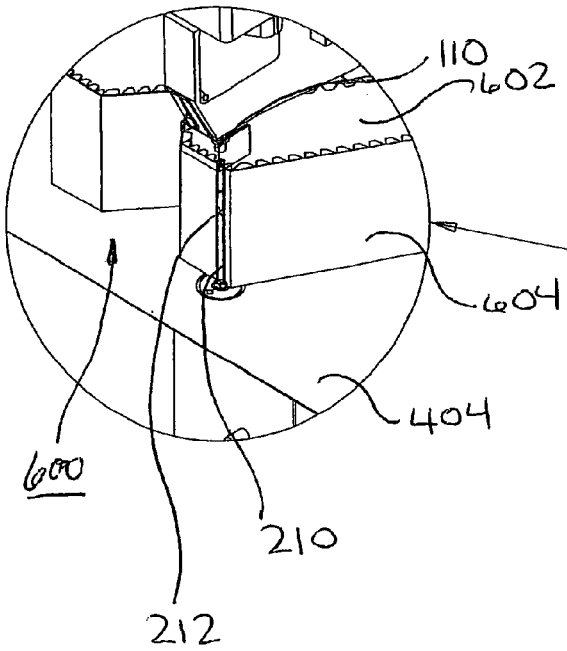
FIG. 11 is a schematic perspective view of a channel letter being placed on the working table showing the lower tooling in the raised position extended inside the formed sides of the channel letter.
Figure 12:
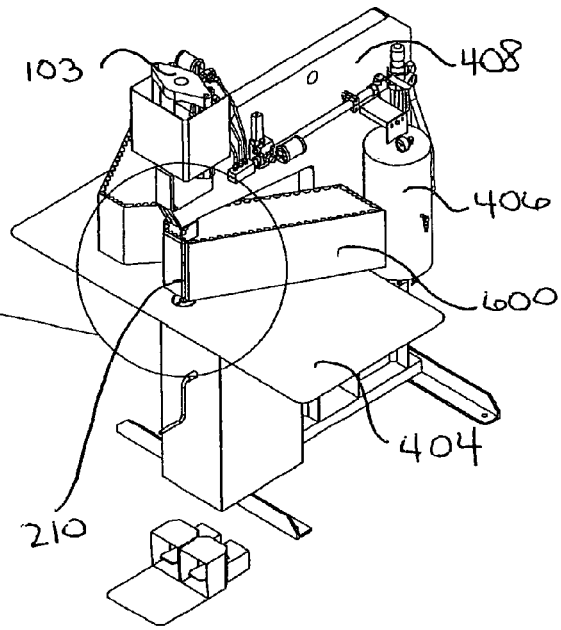
FIG. 12 is a front schematic perspective view of the present invention a long reach press mounted onto a frame together with a channel letter showing the lower tooling in the raised position.

Referring now to FIGS. 10, 11 and 12, FIG. 10 schematically shows channel letter 600 which normally is comprised of formed sides 604 and a backing plate 602. Long reach press 100 typically must clench together the backing plate 602 with the formed sides 604. Channel letter 600 is a typical example of an application of long reach press 100 where a very long penetration of the tooling is required in order to access the area where the actual work must be completed. FIG. 11 for example shows channel letter 600 mounted onto a working table 404 with lower tooling 210 in the raised position 212, wherein upper tooling 110 and lower tooling 210 are just coming into contact. FIG. 12 shows the same features as FIG. 11, however with long reach press mounted into a C-frame 408.

Figures 13, 14, 15:
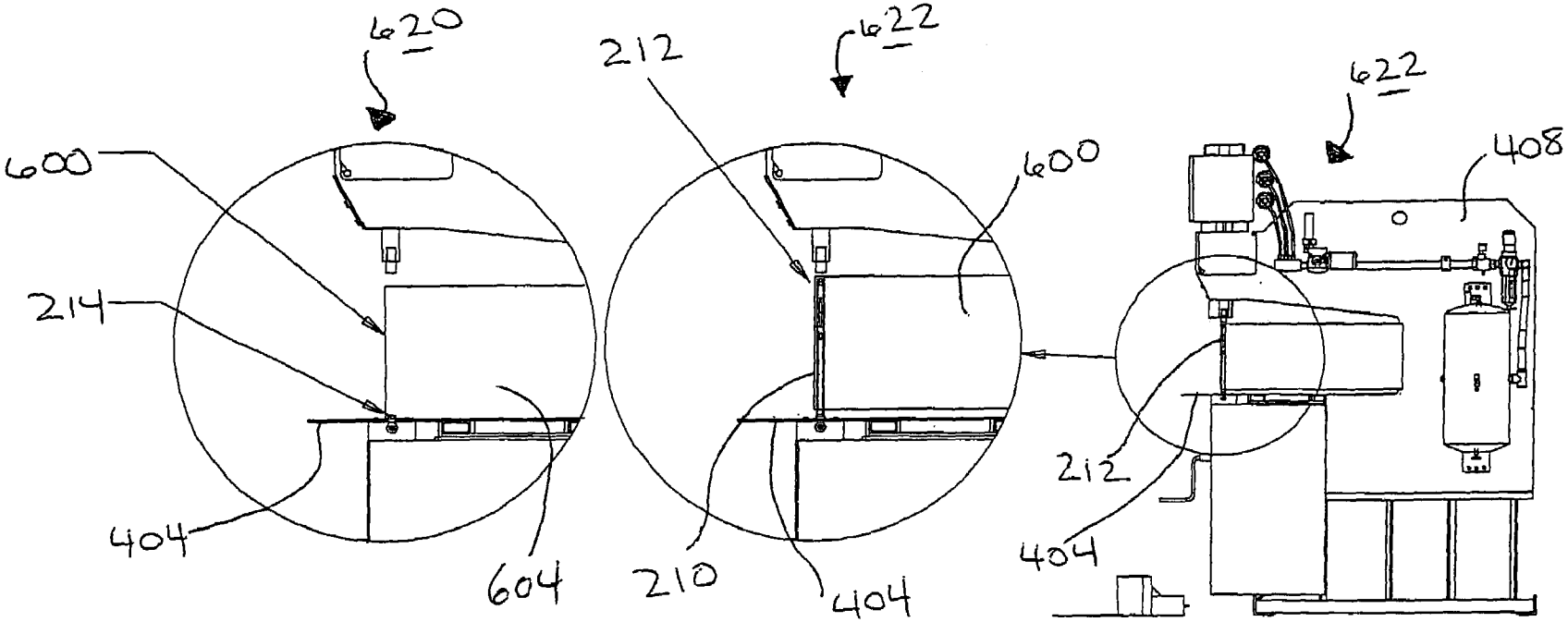
FIG. 13 is a perspective side elevational view showing a channel letter in an insert removed position on a working table with the lower tooling in the lowered position.
FIG. 14 is a schematic side elevational view showing a channel letter in a working position with the lower tooling in the raised position.
FIG. 15 is a side schematic perspective view of the present invention a long reach press together with a frame with a channel letter in the working position on the working table with the lower tooling in the raised position.

FIG. 13 shows schematically a channel letter 600 mounted onto a working table 404 with lower tooling 210 in the lowered position 214 such that when lower tooling 210 is in the lower tooling lowered position 214, one can easily slide channel letter 600 across working table 404 and therefore, in this position long reach press 100 is in the insert remove position 620 as schematically shown in FIG. 13. When channel letter 600 is placed in the desired position, lower tooling 210 is raised to the lower tooling raised position 212 which normally is concealed to the eye since the tooling is raised inside the formed sides 604 of channel letter 600 and therefore, normally unseen. Once lower tooling 210 is raised to the lower tooling raised position 212 as shown in FIG. 14, channel letter 600 is in a working position 622 as shown in FIG. 14 and now the clinching operation between upper and lower tooling using the high force actuator 102 can be activated. FIG. 15 shows the same features as FIG. 14, however with the long reach press 100 mounted into a C-frame 408.

In Use

Referring now to FIGS. 2, 3 and 4, a work piece (not shown) such as a channel number is placed on working table 404 and can be placed in position between upper and lower tooling 110 and 210, by lowering lower tooling 210 to lower position 214 such that the work piece can be slid over lower tooling 210. Lower tooling 210 in FIG. 4 is shown in the lower tooling raised position 212, with lower tooling 210 projecting vertically upward in vertical direction 190 from working table 404. When lower tooling 210 is in the lower tooling lowered position 214, lower tooling 210 is below or flush with working table 404, thereby allowing easy movement of parts across working table 404.

Therefore, as schematically shown in FIG. 3 with lower tooling 210 in lower tooling lowered position 214 a work piece can be placed over lower tooling 210. Once the work piece is in place, lower tooling 210 is raised to the lower tooling raised position 212 (also referred to as the working position) as shown in FIG. 4 and also in FIG. 2, so that subsequent pressing operations can occur between upper tooling 110 and lower tooling 210. Lower tooling 210 can be moved between lower tooling raised position 212 and lower position 214 when slide block stop 312 is in the stop retracted position 315 as shown in FIG. 3. Once the work piece has been put in place over lower tooling 210 and lower tooling 210 is raised to the lower tooling raised position 212, positive stop actuator 302 is engaged by laterally sliding slide block stop 312 from the stop retracted position 315 to the stop extended position 314. Slide block stop 312 positively engages with the bottom of lower tooling 210, such that there is a positive mechanical stop preventing lower tooling 210 from moving downwardly in vertical direction 190. Therefore, a large amount of force can be placed onto lower tooling 210 by high force actuator 102 since lower tooling 210 is rigidly supported by slide block stop 312.

With slide block stop 312 in the stop extended position 314 and lower tooling 210 in the lower tooling raised position 212, high force actuator 102 can now be actuated through upper stroke 114 at high forces. In this manner, parts with very deep profiles such as channel letters can easily be moved across working table 404 to a working position just below upper tooling 110 and clinching, pressing, shearing, stamping and other operations can be carried out by long reach press 100.

A person skilled in the art will see the advantageous of having the ability to raise and lower, lower tooling 210 from below working table top 404. First of all there is ease of movement of parts across table top 404 in that with lower tooling 210 in the lower position 214, parts can easily slide across working table 404 without running into lower tooling 210. With the prior art press 900, the work piece would have to be manually raised above the fixed lower tooling 920 in order to be placed into a working position.

Secondly, lower stroke 220 occurs from below and inside a deep contoured part, thereby eliminating a safety issue, namely that an operator would no longer be exposed to the long stroke movement as in prior art press 900. A person skilled in the art will recognize that this lower pressure long stroke approach of lower tooling 210 can range anywhere from 3 to 15 inches and/or more and therefore, creates a major safety concern in regard to operators being exposed to the movement of lower tooling 210. In the present long reach press 100, the operator is shielded by the actual work piece as lower tooling 210 is raised to the lower tooling raised position 212 within the work piece itself. In the present long reach press 100, not only is the operator shielded by the actual work piece as lower tooling 210 is raised to the lower tooling raised position 212 within the work piece itself, but in addition the operating force of the lower tooling is low enough that operator injury is minimized and normally eliminated.

Furthermore, since high force actuator 102 no longer needs to be moved through both low force stroke 916 as well as a high force stroke 918, more economical high forced actuators 102 can be utilized such as pneumatic units which are ideally suited to providing high force, low stroke actuations at relatively less expense. The prior art long low force stroke 916 shown in prior art press 900 is completely eliminated in that the high force actuator 102 of long reach press 100 only needs to move through the short (½" to 1") upper stroke 114. This also eliminates the controls and the further instrumentation and mechanical arrangements necessary in order to control the movement of the prior art high and low force actuator 902 through both the low force stroke 916 and the high force stroke 918.

Furthermore, the control systems required for the long reach press 100 are greatly simplified in that with the prior art unit, high and low force actuator 902 had to be controlled through a high and low pressure operation which generally requires pre-loaded springs and position sensors and its associated electronic and electrical controls. In long reach press 100, the high and low pressure strokes are separated, in that the low pressure long stroke is achieved from below the table, namely with a separate lower force actuator 202.

Since high force actuator 102 only needs to move through a shorter upper stroke 114, hydraulic cylinders can be eliminated in their entirety and less expensive pneumatic units can be used instead of hydraulic cylinders for high force actuator 102 as well as low force actuator 202 and positive stop actuator 302.

Finally, the long reach press 100 operates much more quickly than the prior art press 900 since the high force actuator 102 which can be a pneumatic unit can cycle much quicker than the hydraulic prior art actuator 902.

Furthermore, a person skilled in the art will note that there is a significant machine size reduction, in that the overall height of the entire long reach press can be lowered since the approach of lower tooling 210 occurs from below, rather than as previously from above. Long reach press 100 utilizes the existing distance between working table 404 and the floor for providing for the low pressure low force approach of lower tooling 210 from the lower tooling lowered position 214 to the lower tooling raised position 212. Therefore, the overall height of long reach press can be lowered essentially by the distance of the low force stroke 916 as shown in FIG. 1 or the distance of the lower stroke 220 as shown in FIG.

2. Therefore, the entire height of the machine can be reduced with its associated cost and space savings.

Persons skilled in the art will recognize that the press may be arranged horizontally rather than vertically in which case a first tooling equivalent to lower tooling 210 and a second tooling equivalent to upper tooling 110 could be horizontally opposed or in other configurations.

It should be apparent to persons skilled in the arts that various modifications and adaptation of this structure described above are possible without departure from the spirit of the invention the scope of which defined in the appended claim.

We claim:

1. A long reach press comprising:

(a) a low force actuator for operably urging first tooling into a working position, the low force actuator including a cylinder, a cylinder rod and a piston oriented in a vertical direction;

(b) an opposed high force actuator for operably urging second tooling into engagement with the first tooling;

(c) the press further including a positive stop actuator oriented perpendicular to the low force actuator and disposed above the low force actuator cylinder, the positive stop actuator for operatively supporting and restraining movement of the first tooling, the positive stop actuator including a slide block stop moving along a lateral plane perpendicular to the low force actuator, d) wherein the slide block stop and the low force actuator capable of moving independently of each other.

2. The long reach press claimed in claim 1, wherein the first tooling being lower tooling, wherein low force actuator operably urging lower tooling through a lower stroke namely from a lower tooling lowered position wherein the lower tooling being laterally adjacent the slide block stop to a lower tooling raised position wherein the lower tooling being above the slide block stop.

3. The long reach press claimed in claim 1, wherein said slide block moveable between a stop extended position and a stop retracted position.

4. The long reach press claimed in claim 2, wherein the lower tooling positioned below and vertically opposed to second tooling being upper tooling positioned vertically above lower tooling.

5. The long reach press claimed in claim 3, wherein the positive stop actuator including a position sensor for monitoring the position of the slide block stop as it moves between the stop extended position and the stop retracted position.

6. The long reach press claimed in claim 3, wherein the slide block stop slideably received within a lower tooling housing which is mounted above the low force actuator cylinder.

7. The long reach press claimed in claim 1, wherein the high force actuator including a WAMP unit capable of moving the upper tooling along an upper stroke and into engagement at high force with the lower tooling.

8. The long reach press claimed in claim 2, wherein the lower tooling when in the lowered position is retracted below a working table such that a work piece can be easily slid over top of the lower tooling.

9. The long reach press claimed in claim 3, wherein said slide block stop being U shaped for operably engaging with a lower tooling stop surface.

10. The long reach press claimed in claim 1, wherein the positive stop actuator including a cylinder, a cylinder rod and a piston oriented perpendicular to the low force actuator.

11. The long reach press claimed in claim 9, wherein the U shaped slide block stop adapted to receive the cylinder rod of the low force actuator between the legs of the U when in the stop extended position.

* * * * *